US010978793B2

(12) United States Patent
Hill

(10) Patent No.: US 10,978,793 B2
(45) Date of Patent: Apr. 13, 2021

(54) ANTENNA WITH GAIN REDUCTION

(71) Applicant: HARADA INDUSTRY OF AMERICA, INC., Novi, MI (US)

(72) Inventor: Shawn Hill, Hubert, NC (US)

( * ) Notice: Subject to any disclaimer, the term of this patent is extended or adjusted under 35 U.S.C. 154(b) by 0 days.

(21) Appl. No.: 16/683,271

(22) Filed: Nov. 14, 2019

(65) Prior Publication Data

US 2020/0358172 A1 Nov. 12, 2020

Related U.S. Application Data

(60) Provisional application No. 62/845,861, filed on May 9, 2019.

(51) Int. Cl.

| | |
|---|---|
| ***H01Q 1/32*** | (2006.01) |
| ***H01Q 9/16*** | (2006.01) |
| *H01Q 1/28* | (2006.01) |
| *H01Q 1/40* | (2006.01) |
| *H01Q 1/24* | (2006.01) |

(52) U.S. Cl.

CPC ..... *H01Q 1/3266* (2013.01); *H01Q 9/16* (2013.01); *H01Q 1/243* (2013.01); *H01Q 1/282* (2013.01); *H01Q 1/32* (2013.01); *H01Q 1/3291* (2013.01); *H01Q 1/40* (2013.01)

(58) Field of Classification Search

CPC .... H01Q 1/3266; H01Q 1/3291; H01Q 1/282; H01Q 1/40; H01Q 9/16; H01Q 1/32; H01Q 1/243; H01Q 1/38; H01Q 1/48

USPC ..... 343/713, 711, 712, 873

See application file for complete search history.

(56) References Cited

U.S. PATENT DOCUMENTS

| | | | | |
|---|---|---|---|---|
| 6,078,294 | A | 6/2000 | Mitarai | |
| 2007/0024512 | A1 | 2/2007 | Muramatsu et al. | |
| 2020/0091608 | A1 * | 3/2020 | Alpman | H01Q 21/24 |

FOREIGN PATENT DOCUMENTS

| | | |
|---|---|---|
| JP | 2016-049808 | 4/2016 |

OTHER PUBLICATIONS

Mukesh Kumar Khandelwal, Binod Kumar Kanaujia, and Sachin Kumar, "Defected Ground Structure: Fundamentals, Analysis, and Applications in Modern Wireless Trends", International Journal of Antennas and Propagation vol. 2017, Article ID 2018527, 22 pages, Feb. 1, 2017, p. 1-p. 22.

* cited by examiner

*Primary Examiner* — Joseph J Lauture
(74) *Attorney, Agent, or Firm* — Soei Patent & Lawfirm

(57) ABSTRACT

An antenna includes an antenna substrate comprising a first end and a second end, and an antenna element attached to the antenna substrate. The antenna element is configured to receive communication signals within a partial hemispherical-shaped signal reception region oriented about the first end of the antenna substrate. A signal gain reduction portion is at least partially located between the antenna element and the second end of the antenna substrate, and is configured to reduce signal gain in an opposite partial hemispherical-shaped region oriented about the second end of the antenna substrate.

20 Claims, 8 Drawing Sheets

ANTENNA WITH GAIN REDUCTION

CROSS-REFERENCE TO RELATED APPLICATION

This application claims the benefit of priority from U.S. Provisional Application No. 62/845,861, filed May 9, 2019, the entire contents of which are incorporated herein by reference.

BACKGROUND

Vehicle-to-everything (V2X) communication is a technology that allows vehicles to communicate with other vehicles, infrastructures, and pedestrians to improve safety, energy/fuel efficiency and traffic flow. V2X can be based on V2X radio technology, cellular based V2X technology (CV2X) or other types of related technologies that provide communication via wireless signals.

A vehicle equipped with V2X technology may contain an onboard communication module and an antenna. The onboard module transmits information about the vehicles speed, direction, position, etc. The V2X antenna may be placed on top of the vehicle or in the passenger cabin. However, V2X antennas placed on roofs may not be able to provide complete 360-degree coverage around the vehicle, and certain types of integrated multimedia antennas can block the signal in a given direction.

The addition of another antenna placed in a rearward or forward position on the vehicle may obstruct the driver's view. For example, an antenna may be placed in the windshield of the vehicle, however this space is already becoming crowded with other items such as front mounted cameras, rain sensors, heating elements, etc., and the available space is expected to decrease further with the adoption of autonomous vehicles.

These and other problems are addressed in the present application.

SUMMARY

Disclosed herein is an example antenna with gain reduction. The antenna may be mounted in a side view mirror of an automotive vehicle.

The antenna may include an antenna substrate comprising a first end and a second end, and an antenna element attached to the antenna substrate. The antenna element may be configured to receive communication signals within a partial hemispherical-shaped signal reception region oriented about the first end of the antenna substrate. A signal gain reduction portion may be located at least partially located between the antenna element and the second end of the antenna substrate, and may be configured to reduce signal gain in an opposite partial hemispherical-shaped region oriented about the second end of the antenna substrate.

DETAILED DESCRIPTION

In the following description, with reference to the drawings, the same reference numbers are assigned to the same components or to similar components having the same function, and overlapping description is omitted.

Figure 1:
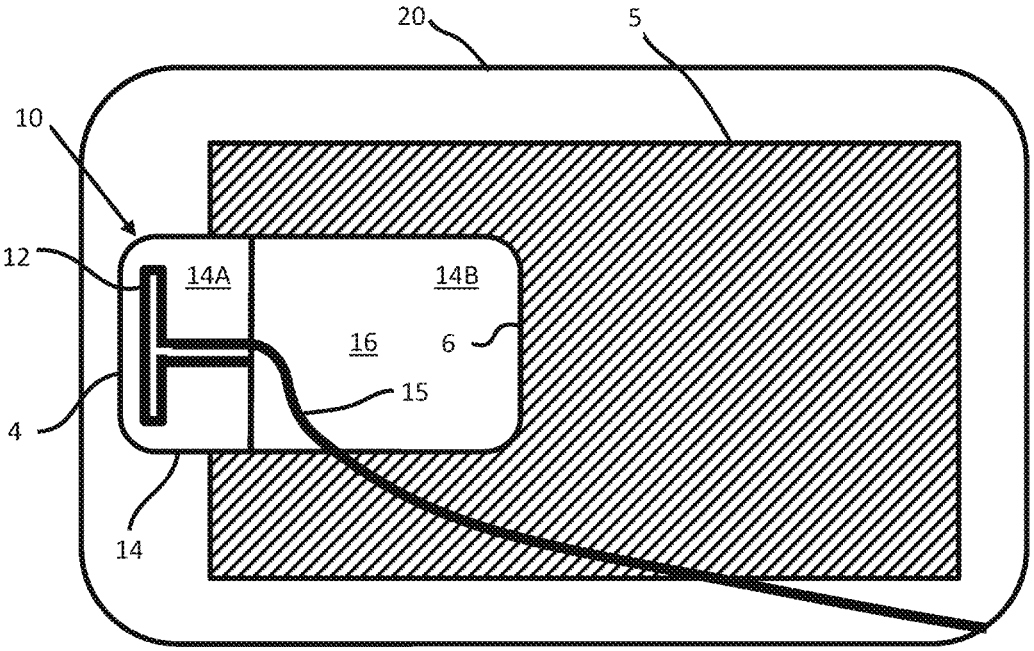
FIG. 1 illustrates a planar view of an example antenna and antenna housing.

FIG. 1 illustrates a planar view of an example antenna 10. The antenna 10 may be located in an antenna housing 20, such as a side mirror of an automotive vehicle. The antenna 10 may comprise an antenna element 12, such as an antenna pattern, located on an antenna substrate 14 and connected to an antenna cable 15. In some examples, the antenna element 12 may comprise a metal plate or a wire.

Additionally, the antenna 10 may comprise a signal attenuation portion or signal gain reduction portion 16. In some examples, the antenna element 12 may be located at or near a first end 4 of the antenna substrate 14 and the signal gain reduction portion 16 may be located at or near a second end 6 of the antenna substrate 14 opposite the first end 4. For example, the antenna element 12 may be located on or at a first portion 14A of the antenna substrate 14 associated with the first end 4, and the signal gain reduction portion 16 may be located on or at a second portion 14B of the antenna substrate 14 associated with the second end 6. The antenna substrate 14 may comprise an antenna board or circuit board.

The antenna element 12 may be attached to the antenna substrate 14 and configured to receive communication signals. In some examples, the antenna element 12 may be configured to receive the communication signals within a partial hemispherical-shaped signal reception region oriented about the first end 4 of the antenna substrate 14. Additionally, the signal gain reduction portion 16 may be at least partially located between the antenna element 12 and the second end 6 of the antenna substrate 16. The signal gain reduction portion 16 may be configured to reduce signal gain in an opposite partial hemispherical-shaped region oriented about the second end 6 of the antenna substrate 16.

The antenna element 12 (such as a wire or plate) may be partially located on the antenna substrate 14. For example, a first part of the antenna element 12 may be mounted to the antenna substrate 14 and a second part of the antenna element 12 may extend past the first end 4, outside of the antenna substrate 14.

In some examples, the antenna element 12 may comprise a dipole antenna having two terminals, including a first terminal electrically coupled to the signal gain reduction portion and a second terminal electrically coupled to the antenna cable 15.

The antenna housing 20 may comprise one or more signal blocking structures 5, such as a mirror or a metallic component. The antenna element 12 may be located beyond the outer peripheral edge of the structure 5 to provide a clear path for receipt of signals. On the other hand, the signal gain reduction portion 16 may be located within the outer peripheral edge of the structure 5 with respect to the planar view of the antenna 10. In some examples, the signal gain reduction portion 16 may be located behind a reflective surface of a side view mirror.

The signal blocking structure 5 may be oriented substantially lengthwise in the antenna housing 20. The first end 4 of the antenna substrate 14 may extend outside the signal blocking structure 5 from a front side perspective of the antenna housing 20, and the second end 6 of the antenna substrate 14 may be located behind the signal blocking structure 5 from the front side perspective.

Figure 2:
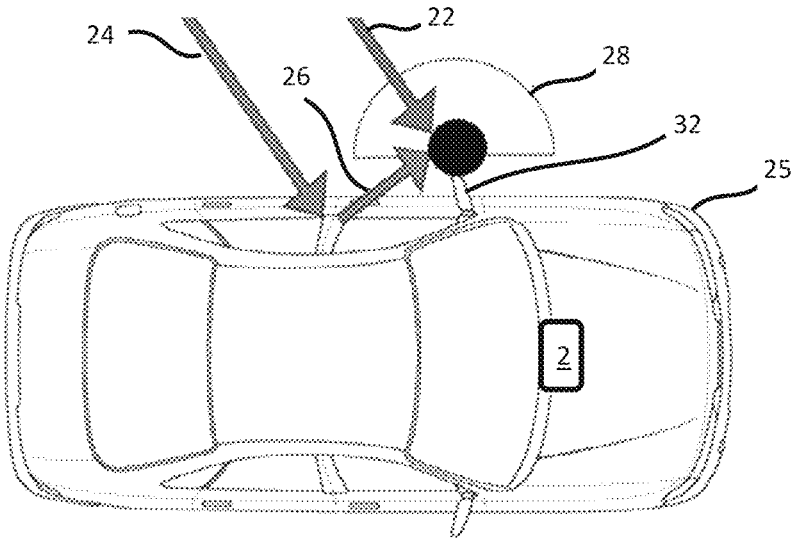
FIG. 2 illustrates an example antenna mounted to a vehicle.

FIG. 2 illustrates an example antenna 32 mounted to a vehicle 25. The antenna 32 may be associated with a partial hemispherical-shaped signal reception region 28 from which the antenna 32 may be configured to receive primary signals 22. In some examples, the body of the vehicle 25 may act like an infinite ground plane to the antenna 32 due the size of the metallic portion of the vehicle body being much greater than the wavelength for the frequencies used for V2X communication. Due to this infinite ground plane, any radiation or signals 24 of sufficient gain emitted towards the vehicle body may cause a reduction in gain from reflections 26 in an opposite hemisphere, for example an opposite partial hemispherical-shaped region. Accordingly, any reflections 26 from the ground plane, which returns to the antenna 32, may cause interference for the reverse angle. Additionally, any metallic components inside the antenna housing may cause interference for the antenna 32. By locating the antenna 32 toward the edge of the antenna housing, as illustrated in FIG. 1, the interference may be reduced.

As signal frequencies move or become higher, coax cables become more lossy, which may degrade the signal from the antenna 32 to an onboard communication module 2. V2X antennas located on the roof or the windshield of the vehicle 25, for example, may experience signal degradation due to cable loss and routing. Antennas in these locations may be connected to relatively long lengths of cable that are routed to the on-board communication module. The signal degradation occurring at Wi-Fi frequencies of 5.85-5.925 GHz which are used for V2X communications may result in a high attenuation in the coax cables. The attenuation can be reduced by using a larger diameter cable such as RG-58 LL. However, a larger diameter increases cost and introduces size constraints.

V2X antennas placed into reduced height roof mounted antennas (e.g., "shark fins") may not provide adequate coverage all around the vehicle due to the sloping vehicle roof and design constraints on the placement of the antenna. For example, the antenna may experience significant reductions in gains at certain angles due to reflections of signals from the vehicle body.

Additionally, the placement of V2X antennas on the roof may also create signal reception issues for vehicles with a panoramic roof or glass opening such as a moon roof, or a sun roof. Due to the thickness of the glass and the high permittivity of the material, surface waves from the V2X signals may couple into the glass. When these signals are coupled into the glass, the radiation output may be significantly reduced in one or more directions, causing a reduction in signal strength.

In some examples, the communication module 2 may be contained below the vehicle dash. The dash has ample room for placement of the communication module 2. By having the antenna 32 located in a side view mirror, and with the communication module 2 located under the vehicle dash in the front of the passenger compartment, a reduced length of antenna cable may be used due to the close proximity of the antenna 32 to the communication module 2.

As discussed above, the location of the antenna 32 relative to the vehicle 25 may affect the performance of the antenna 32. In some examples, the antenna 32 may be configured to provide a significant reduction in gain to the rear of the partial hemispherical-shaped signal reception region 28 (i.e., in the direction of the vehicle 25). Additionally, the antenna 32 may be configured to accommodate the reduction in gain of the antenna 32 that results from interference with the A-pillar (i.e., the forward most roll-bar) of the vehicle 25. In some vehicles, the A-pillar is located adjacent the rear view mirror. The interaction of the antenna 32 with this A-pillar may cause multipath interference in the absence of a signal attenuating structure.

Figure 3:
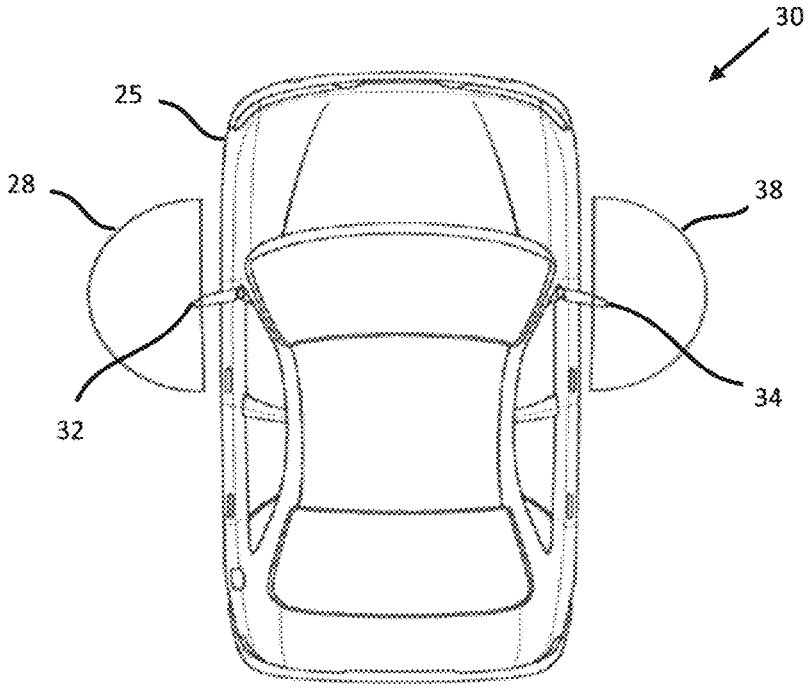
FIG. 3 illustrates an example communication system having two antennas.

FIG. 3 illustrates an example communication system 30 having two antennas 32, 34. The two antennas 32, 34 may be placed into the two side view mirrors, respectively, of the vehicle 25 to provide additional communication and/or signal reception coverage. Two antennas 32, 34 can mitigate design factors from the vehicle 25 affecting the overall radiation pattern. The design factors may include a panoramic roof (e.g., a sun roof or moon roof), steep sloping roof top, or unconventional antenna placements. In some examples, a first antenna, e.g., antenna 32, may be placed in the driver's side view mirror, and a second antenna, e.g., antenna 32, may be placed in the passenger side view mirror.

The first antenna 32 and the second antenna 34 may be configured to provide 360 degree signal reception coverage around the vehicle 25. In some examples, the 360 degree signal reception coverage may be determined within the range from +10° to −6° from a horizontal plane (see FIG. 13) that passes through one or both antennas 32, 34, or which may otherwise include the range within which signals are most likely to be received by the antennas 32, 34.

The second antenna 34 may include a second antenna element configured to receive communication signals within a second partial hemispherical-shaped signal reception region 38. The second partial hemispherical-shaped signal reception region 38 combined with the first partial hemispherical-shaped signal reception region 28 may form a 360 degree signal reception region. Additionally, the second antenna 34 may comprise a second signal gain reduction portion configured to reduce signal gain in a second partial hemispherical-shaped region oriented opposite to the second partial hemispherical-shaped signal reception region 38. The first signal gain reduction portion of the first antenna 32 and the second signal gain reduction portion of the second antenna 34 may both be configured to attenuate signals which are reflected from the vehicle 25.

Each antenna 32, 34 may be configured to uniformly cover a hemisphere on one side of the vehicle 25. For example, the first antenna 32 may be configured to receive signals within the partial hemispherical-shaped signal reception region 28 located on the left-hand side of the vehicle 25, whereas the second antenna 34 may be located on the right-hand side of the vehicle 25 to receive signals within the second partial hemispherical-shaped signal reception region 38. When combined, both antennas 32, 34 may be configured to provide communication coverage in a uniform sphere (or partial spherical-shaped region) surrounding the vehicle 25. Creating a uniform sphere of radiation pattern coverage surrounding the vehicle 25 enables communications with other vehicles approaching from any number of directions.

The shape and efficiency of the partial hemispherical-shaped signal reception regions 28, 38 may be adjusted according to the length of the vehicle body, the spacing of the mirror from the vehicle body, the height of the antennas 32, 34 in relation to the vehicle body, the placement of the antennas 32, 34 relative the antenna housings, and the presence of windows vs. metal panels in proximity to the antennas 32, 34.

Due to the different types of vehicle shapes and designs, the antennas 32, 34 may be operated in a vehicular communications environment which has a tendency to result in a higher amount of gain in the rear hemisphere of the vehicle 25. Accordingly, the antennas 32, 34 may be configured to attenuate or reduce the amount of radiation into the rear hemisphere.

Figure 4:
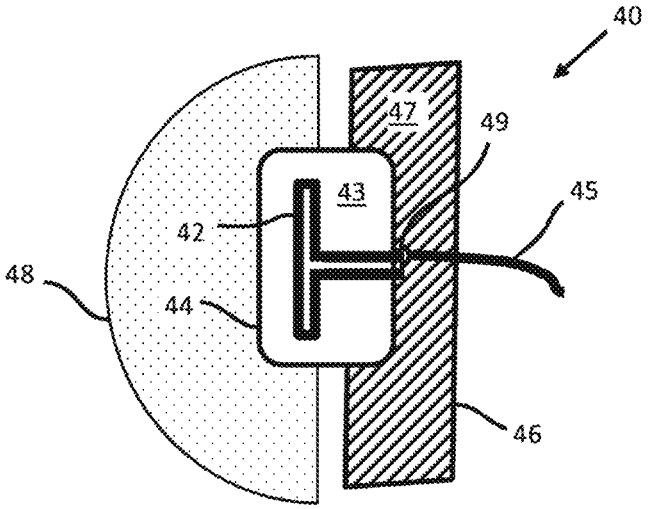
FIG. 4 illustrates an example antenna comprising a reflector.

FIG. 4 illustrates an example antenna 40 comprising a reflector 46 having a reflective surface 47. The antenna 40 may comprise an antenna board or antenna substrate 44 which is oriented substantially perpendicular to the reflective surface 47. In other examples, the antenna substrate 44 may be angularly offset from the reflective surface 47 at some non-perpendicular angle.

The reflector 40 may comprise an antenna element 42 that is attached to or located on a surface 43 of the antenna substrate 44. In some examples, the surface 43 may be substantially planar and angularly offset from the reflective surface 47. The antenna element 42 (e.g., antenna pattern) may be connected to an onboard communication module or other signal processing device via an antenna cable 45. The antenna cable 45 may be inserted in a through-hole 49 of the reflector 46.

A hemispherical-shaped signal reception region 48 of the antenna 40 may be created with the use of the reflector 46. In some examples, one or more conductive surface reflectors (e.g., metal plates) may be used to control the shape of the radiation pattern associated with the antenna 40. This radiation pattern shape can be controlled by the width, height, spacing and angular orientation of the reflector 46 from the antenna 40, for example, in order to achieve a particular reduction of gain in the rear hemisphere. The antenna element 42 may be oriented away from the reflector 46 in the direction of the hemispherical-shaped signal reception region 48. For example, with respect to the vehicle 25 of FIG. 3, the reflector 46 may be located between the antenna element 42 and the body of the vehicle 25.

Other example antennas which are configured to reduce attenuation into the rear hemisphere include reflectors made from electromagnetic band gap periodic structures. This type of reflector may be made from a conductor (e.g., copper or another type of metal. In some examples, electron states at the specified energy levels (frequencies) may be prohibited from existing in the structures, in which case the radiation from the antenna at the specified frequency may prohibited from passing through the structures. Therefore the surface may be configured to impede the surface currents at those frequencies and prevent them from propagating. Since the currents are not propagated in that direction, the radiation is attenuated on that side.

The antenna may be spaced away from the reflector by a predetermined distance to achieve a smaller antenna design. In examples in which the reflector is used to reflect the radiation rather than allowing it to pass through and attenuating it, the antenna may be spaced further from this surface in order to have high efficiency. Efficiency may be determined by a comparison of Voltage Standing Wave Ratio (VSWR) to the reflection coefficient (RC), or VSWR/RC. In some examples, electromagnetic band gap (EBG) enhanced reflectors may be used instead of a larger reflector design to attenuate radiation in a rear hemisphere.

In addition to, or in place of, a reflector to optimize the gain reduction for the rear hemisphere of the antenna, some example antennas may include ground planes in which defects are introduced to help attenuate surface waves. Still further, the antenna may be configured with coplanar type ground planes to further reduce radiation behind the antenna.

Figure 5:
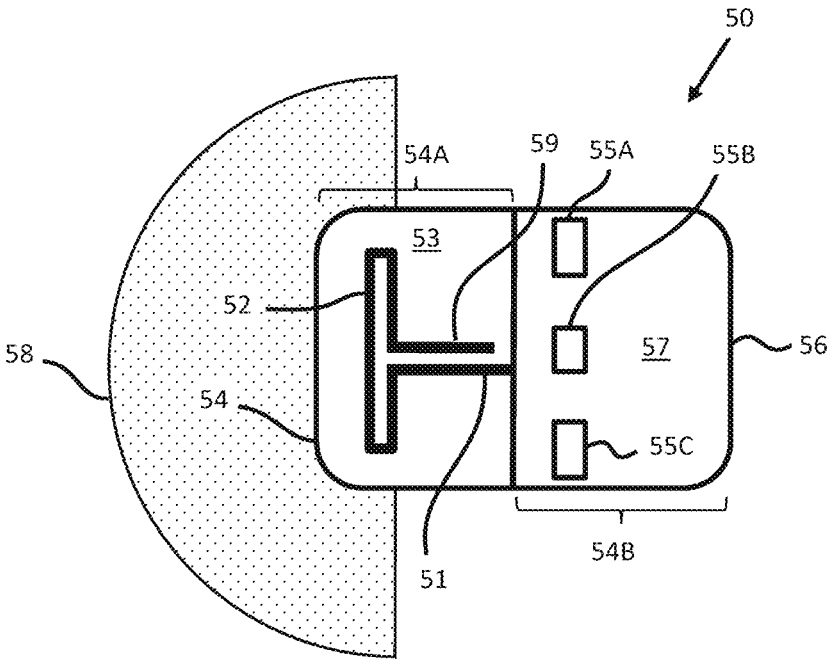
FIG. 5 illustrates an example antenna comprising a signal attenuating structure.

FIG. 5 illustrates an example antenna 50 comprising a signal attenuating structure or signal gain reduction structure 56.

The antenna 50 comprises an antenna element 52 configured to emit and/or receive signals within a signal reception region 58, for example a hemispherical-shaped signal reception region. The antenna element 52 may be formed on a first portion 54A associated with a first end of an antenna board 54, for example as a conductive pattern layered on an antenna board substrate 53. Additionally, the antenna element 52 may include or be coupled to an antenna terminal 51 and a cable terminal 59.

The signal gain reduction structure 56 may comprise one or more signal attenuation features 55A, 55B, 55C formed in a surface layer 57. In some examples, the surface layer 57 may comprise a conductive material coupled to the antenna terminal 51. Additionally, the surface layer 57 may be formed on second portion 54B of the antenna board 54, opposite from the antenna element 52. In other examples, the surface layer 57 may be formed on a substrate of the signal gain reduction structure 56.

The signal gain reduction structure 56 may be substantially coplanar with the antenna board 54. Additionally, surface layer 57 may be substantially coplanar with the surface of the antenna element 52. In some examples, the plurality of signal attenuation features 55A, 55B, 55C may be linearly arranged perpendicular to a longitudinal direction from the first end to the second end of the antenna board substrate 53.

The signal attenuation features 55A, 55B, 55C may comprise one or more etched portions in the surface layer 57 of the signal gain reduction structure 56. In some examples, the signal attenuation features 55A, 55B, 55C may comprise through-holes. Additionally, the signal attenuation features 55A, 55B, 55C may be spaced apart from each other and aligned in a row. For example, a row of signal attenuation features 55A, 55B, 55C may be located at an approximate midpoint of the antenna 50.

The antenna element 52 may comprise a conductive pattern formed on the antenna board substrate 53, wherein the conductive pattern is substantially coplanar to the surface layer 57 of the signal gain reduction structure 56. In some examples, the antenna element 52 may be electrically coupled to the surface layer 57 of the signal gain reduction structure 56. The antenna element 52 and the surface layer 57 may be located on a face of the antenna 50, and the surface layer 57 may cover at least 50% of the face of the antenna.

In some examples, one or more of the signal attenuation features 55A, 55B, 55C may be approximately 3 to 6 mm in width, and may be spaced apart from each other by 7 to 9 mm. Still further, the signal attenuation features 55A, 55B, 55C may be spaced approximately 3 to 6 mm from the edge of the surface layer 57 that is electrically coupled to the antenna terminal 51. The widths of the signal attenuation features 55A, 55B, 55C may vary. For example, the widths of the two outer attenuation features 55A, 55C may be approximately 5 mm, whereas the width of the inner signal attenuation features 55B may be approximately 4 mm. Still further, the lengths of the signal attenuation features 55A, 55B, 55C in the longitudinal direction of the antenna 50 may be approximately the same.

In some examples the lengths of the signal attenuation features 55A, 55B, 55C may be approximately 3.5 mm, and additionally the signal attenuation features 55A, 55B, 55C may be spaced approximately 3.5 mm from the edge of the surface layer 57 that is electrically coupled to the antenna terminal 51, in the longitudinal direction of the antenna 50. The signal attenuating structure 56 may measure approximately 30 mm in width and 24 mm in length, in the longitudinal direction of the antenna 50.

In addition to the use of conductive surfaces for reflectors, the antenna 50 may include one or more structures built out of the conductive surface. These structures may be configured to attenuate radiation into the hemisphere behind the antenna. In some examples the signal attenuating structure 57 may comprise a Defective or Defected Ground Plane (DGP).

By adding attenuation features 55A, 55B, 55C, or "defects", into the surface layer 57, or ground plane, surface waves propagating through the substrate may be attenuated, thereby reducing radiation into the rear hemisphere from the propagation inside the substrate and across the metal surface of the antenna. The positions, size and number of defects may be configured to provide the maximum amount of gain reduction into the rear hemisphere. Additionally, removing material from the metal reflective plane may be used to further reduce the gain. The DGP may be configured to include a number of cut outs, with the position and size of the cut outs selected to increase the efficiency of the antenna. Adding in the defects to the ground plane accomplishes the reduction in gain with a smaller reflector, and therefore the antenna size may be minimized.

By configuring a reflector to absorb radiation in the rear hemisphere, the amount of reflections which interfere with the semi-circular radiation pattern may be reduced. In some examples, coplanar ground plane antennas may be more effective in reducing interference than a flat reflector. Adding defects or electromagnetic band gap structures to the reflector to reduce surface waves in the substrate can be used to attenuate radiation into the rear hemisphere of the antenna.

The reflector size, shape and spacing with respect to the antenna may be configured to control the radiation pattern of a dipole and create a viable antenna for the side view mirror, for example at V2X frequencies assigned for vehicle operation. Additionally, the defect size, position and number in the ground plane may be selectively configured to reduce radiation being emitted by the antenna from the reflector side. This radiation may be due to surface waves propagating through the antenna's substrate.

The DGP may be configured to attain effective capacitor and inductor characteristics by intentionally etching slots or defects on the ground plane. In some examples, the antenna comprises copper on FR-4 substrate. The defects may consist of copper that was removed from substrate. The DGP changes characteristic impedance of the ground plane. Implementing defects causes the ground plane size to change in relation to element. This allows antenna element to operate at higher or lower order current mode to change radiation pattern. In some examples, the substrate may include slots to reduce the size of the ground plane to operate at a higher frequency current mode.

Figure 6:
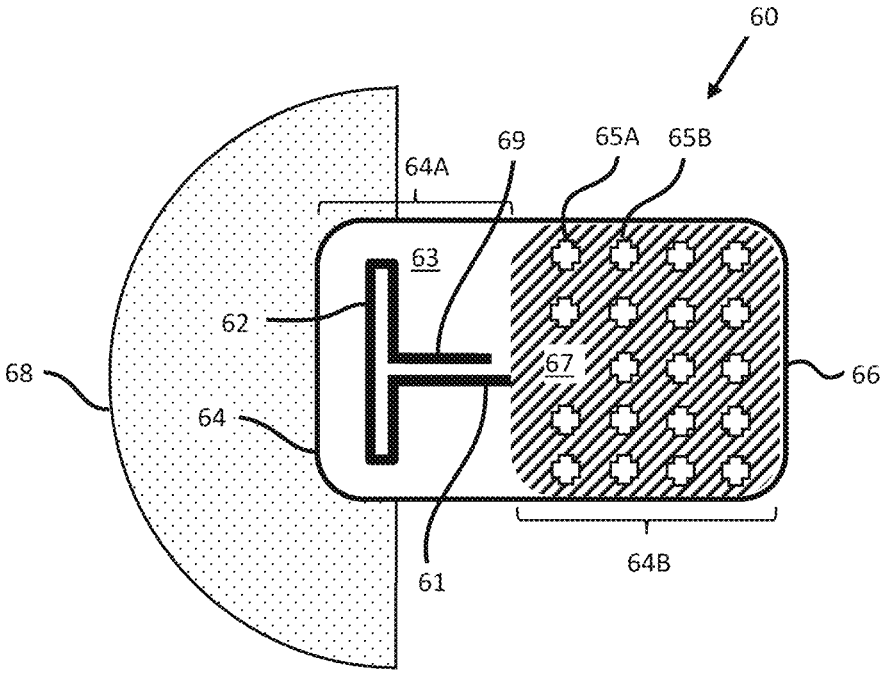
FIG. 6 illustrates an example antenna comprising a coplanar signal attenuating structure.

FIG. 6 illustrates an example antenna 60 comprising a coplanar signal attenuation or gain reduction structure 66.

The antenna 60 comprises an antenna element 62 (e.g., antenna pattern) configured to emit and/or receive signals within a signal reception region 68, for example a hemispherical-shaped signal reception region. The antenna element 62 may be formed on a first portion 64A or near a first end of an antenna board 64, for example as a conductive pattern layered on an antenna board substrate 63. Additionally, the antenna element 62 may include or be coupled to an antenna terminal 61 and a cable terminal 69.

The signal gain reduction structure 66 may comprise one or more signal attenuation features 65A, 65B formed in a surface layer 67. In some examples, the surface layer 67 may comprise a conductive material coupled to the antenna terminal 61. Additionally, the surface layer 67 may be formed on a second portion 64B of the antenna board 64, associated with a second end opposite from the antenna element 62. In other examples, the surface layer 67 may be formed on a substrate of the signal attenuation structure 66. The signal gain reduction structure 66 may be substantially coplanar with the antenna board 64. Additionally, surface layer 67 may be substantially coplanar with the surface of the antenna element 62.

The signal attenuation features 65A, 65B may comprise an array of non-conductive signal attenuation features arranged as a plurality of rows comprising a number of etched portions in the surface layer 67 of the signal gain reduction structure 66. The etched portions may expose a non-conductive portion of the signal gain reduction structure 66.

In some examples, the antenna features and/or the EBG structure(s) may be located on one side of the antenna board substrate. Therefore, it can be realized with a single-sided NEMA grade glass-reinforced epoxy laminate material (e.g., FR-4), ceramic or other type of substrate with layered metal surface material.

The EBG structures may be configured to reduce surface waves propagating through the substrate, to reduce spacing of antenna to reflective surface, and to maximize the attenuation of radiation into the rear hemisphere, thereby decreasing the required size for an antenna.

In some examples, the EBG structures may be configured to allow the antenna to be used across wide variety of vehicles and to achieve a maximum reduction in gain for rear hemisphere, and such that the design elements of the vehicle may have less effect on antenna performance. Still further, a relatively small EBG Cell size may be used, and the type of EBG material may be selected depending on the periodicity of the unit cell.

Figure 7:
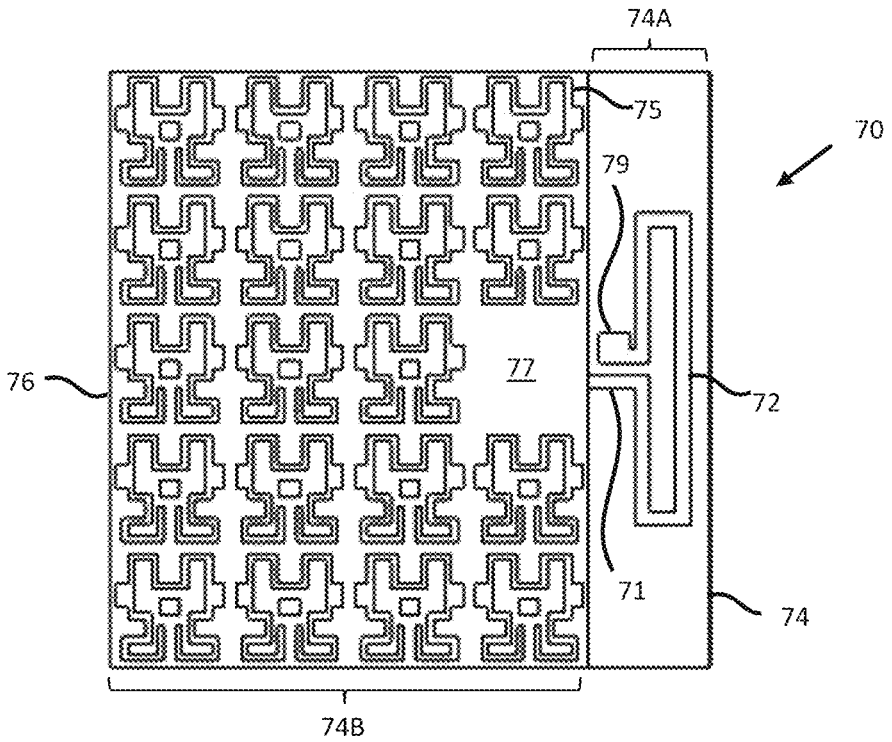
FIG. 7 illustrates another example antenna comprising a coplanar signal attenuating structure.

FIG. 7 illustrates another example antenna 70 comprising a coplanar signal attenuation or gain reduction structure 76.

The antenna 70 comprises an antenna element 72 (e.g., antenna pattern) formed on a first portion 74A or near a first end of an antenna board or antenna substrate 74. Additionally, the antenna element 72 may include or be coupled to an antenna terminal 71 and a cable terminal 79.

The signal gain reduction structure 76 may comprise one or more signal attenuation features 75 formed in a surface layer 77 of the signal gain reduction structure 76. In some examples, the surface layer 77 may comprise a conductive material coupled to the antenna terminal 71. Additionally, the surface layer 77 may be formed on a second portion 74B associated with a second end of the antenna substrate 74, opposite from the antenna element 72. In other examples, the surface layer 77 may be formed on a substrate of the signal gain reduction structure 76. The signal gain reduction structure 76 may be substantially coplanar with the antenna substrate 74. Additionally, surface layer 77 may be substantially coplanar with the surface of the antenna element 72.

The signal attenuation features 75 may be configured as a plurality of rows comprising a number of etched portions in the surface layer 77 of the signal gain reduction structure 76. The etched portions may expose a non-conductive portion of the signal gain reduction structure 76.

Figure 8:
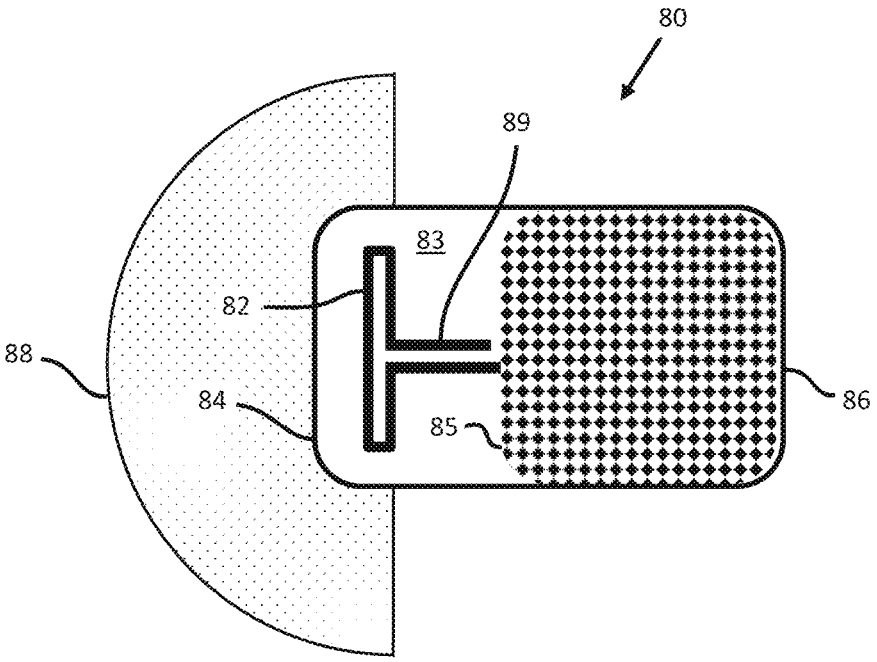
FIG. 8 illustrates an example antenna comprising yet another coplanar signal attenuating structure.

FIG. 8 illustrates an example antenna 80 comprising yet another coplanar signal attenuation or gain reduction structure 86.

The antenna 80 comprises an antenna element 82 (e.g., antenna pattern) configured to emit and/or receive signals within a signal reception region 88, for example a hemispherical-shaped signal reception region. The antenna element 82 may be formed on a first portion or near a first end of an antenna board or antenna substrate 84. Additionally, the antenna element 82 may include or be coupled to a cable terminal 89.

The signal gain reduction structure 86 may comprise one or more signal attenuation features 85 formed on a portion of the signal attenuation structure 86 opposite the antenna element 82. In some examples, the signal attenuation features 85 may comprise a conductive material coupled to the antenna element 82. The signal gain reduction structure 86 may be substantially coplanar with the antenna substrate 84. Additionally, signal attenuation features 85 may be substantially coplanar with the surface of the antenna element 82.

The signal attenuation features 85 may be configured as a plurality of rows each comprising a number of features located on a surface of the signal gain reduction structure 86. In some examples, the signal attenuation features 85 may be separated from each other by a non-conductive portion of the signal gain reduction structure 86.

Figure 9:
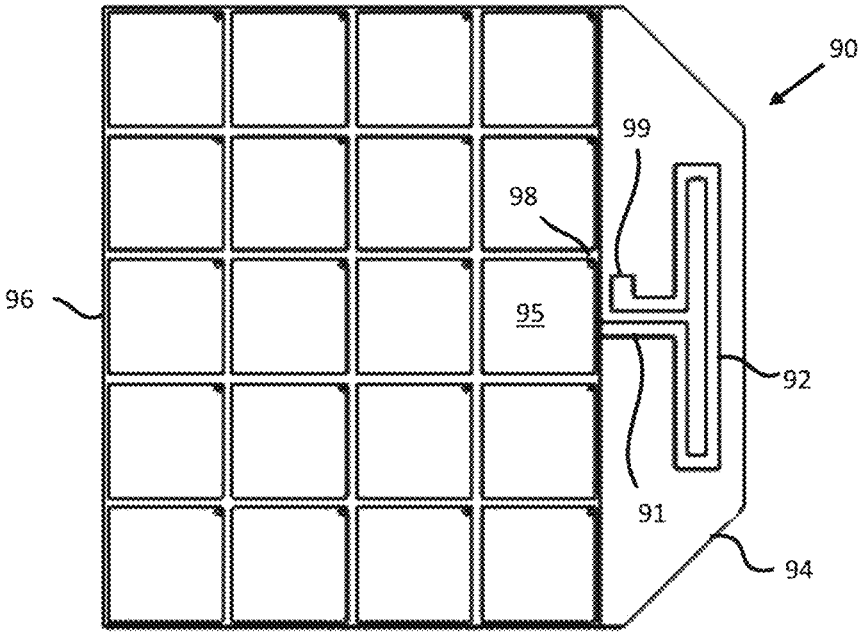
FIG. 9 illustrates an example antenna comprising a double-sided signal attenuating structure.

FIG. 9 illustrates an example antenna 90 comprising a double-sided signal attenuation or gain reduction structure 96.

The antenna 90 comprises an antenna element 92 (e.g., antenna pattern) formed on a first portion or near a first end of an antenna board or antenna substrate 94. Additionally, the antenna element 92 may include or be coupled to an antenna terminal 91 and a cable terminal 99.

The signal gain reduction structure 96 may comprise one or more signal attenuation features 95 formed on a portion of the signal gain reduction structure 96 opposite the antenna element 92. In some examples, the signal attenuation features 95 may comprise a conductive material coupled to the antenna element 92. The signal gain reduction structure 96 may be substantially coplanar with the antenna substrate 94. Additionally, signal attenuation features 95 may be substantially coplanar with the surface of the antenna element 92.

The signal attenuation features 95 may be configured as a plurality of rows each comprising a number of features located on a surface of the signal gain reduction structure 96. In some examples, the signal attenuation features 95 may be separated from each other by a non-conductive portion of the signal gain reduction structure 96.

Each of the signal attenuation features 95 may comprise a through-hole 98. The through-hole 98 may penetrate through the signal gain reduction structure 96. In some examples, the through-holes 98 may comprise conductive inner surfaces which are electrically coupled to the signal gain reduction structures 96.

A double-sided or "mushroom" type EBG (MEBG) structure can be realized with a double-sided FR-4, ceramic or other type of substrate with layered metal surface material. In some examples, one or more layers of EBG materials may be added to further enhance reduction in gain. In addition to EBG materials, other micro-strip structures can be integrated into the antenna to enhance its performance. Example structures may include baluns, micro-strip lines for antenna detection circuits, or matching circuits.

Figure 10:
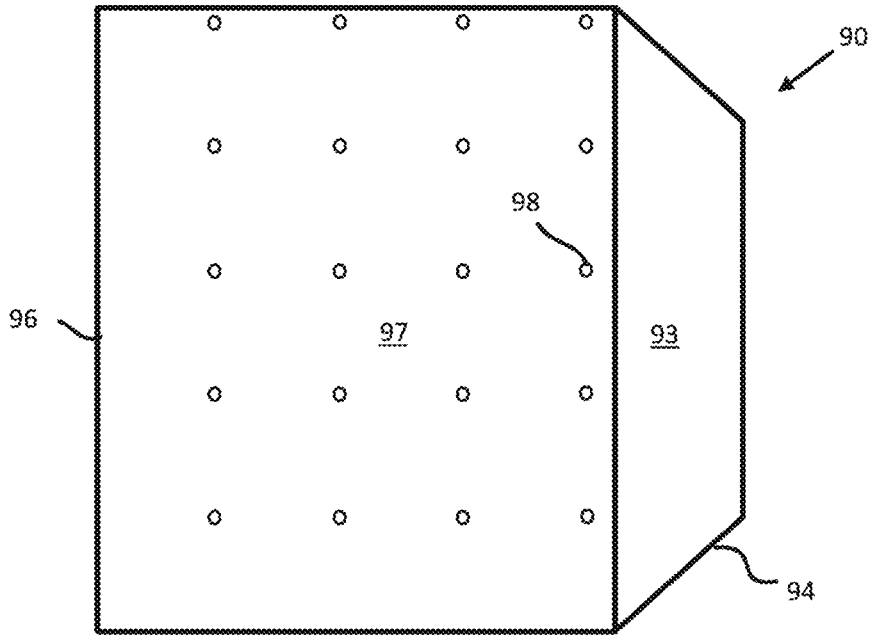
FIG. 10 illustrates an opposite side view of the example antenna of FIG. 9.

FIG. 10 illustrates an opposite side view of the example antenna 90 of FIG. 9.

The opposite side of the antenna board 94 from the antenna element 92 may comprise an antenna board substrate 93 located at or near the first end of the antenna board 94. A surface layer 97 of the signal gain reduction structure 96 may be located adjacent to the first end of the antenna board 94. In some examples, the surface layer 97 may comprise a conductive material electrically coupled to the through-holes 98. Accordingly, the surface layer 97 may be electrically coupled to the signal attenuation features 95 and, by extension, the signal attenuation features 95 may be electrically coupled to each other via the surface layer 97. Additionally, the antenna element 92 (FIG. 9) may be electrically coupled to the conductive layer 97.

In the mushroom EBG (MEBG) structure, the radiation to the side with solid ground plane tapers off faster. The solid ground plane side faces rear of vehicle. The rear of vehicle creates many chances for reflections. Having the gain taper off quickly towards that side may provide for more efficient signal reception. Additionally, in the MEBG structure, the gain tapers off towards the rear more than other antennas and the gain towards the front being slightly higher than other antennas while maintaining a strong reduction in gain after the 0-degree mark.

Figure 11:
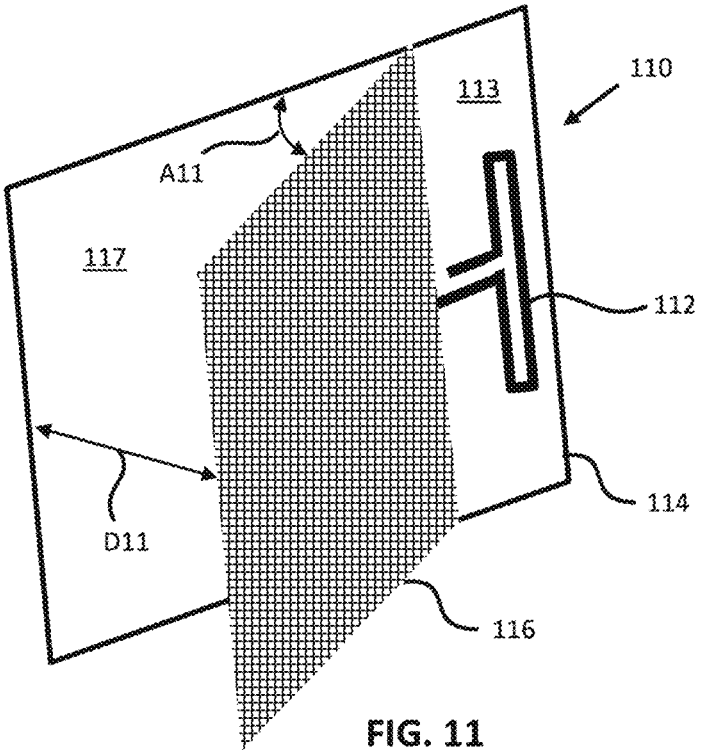
FIG. 11 illustrates an example antenna comprising an offset signal attenuating structure.

FIG. 11 illustrates an example antenna 110 comprising an offset signal attenuation or gain reduction structure 116.

The antenna 110 comprises an antenna element 112 (e.g., antenna pattern) formed on a first portion or near a first end of an antenna board 114. For example, the antenna element 112 may be formed on an antenna substrate 113. Additionally, the antenna element 112 may include or be coupled to a cable terminal.

In some examples, the antenna board 114 may comprise a first signal attenuation surface 117 located substantially coplanar to the antenna element 112, and a second signal attenuation surface 116 may be spatially offset from the first signal attenuation surface 117. The antenna element 112 may be electrically coupled to the second signal attenuation surface 116.

The second signal attenuation surface 116 may be spatially offset from the antenna board 114 by a distance D11. In some examples, the second signal attenuation surface 116 may be angularly offset from the antenna board 114 by an angle A11. The second signal attenuation surface 116 may be attached to the antenna substrate 113.

Additionally, the antenna 110 may comprise a coplanar signal attenuating structure (attenuation surface 117) which is substantially coplanar to the antenna board 114. In some examples, the signal gain reduction structure (second signal attenuation surface 116) may be spatially offset from the coplanar signal attenuating structure 117 by the distance D11. Still further, the signal gain reduction structure 116 may be angularly offset from the coplanar signal attenuating structure 117 by the angle A11.

In some examples, the antenna element 112 may be electrically coupled to one or both of the offset signal gain reduction structure 116 and the coplanar signal attenuating structure 117.

Figure 12:
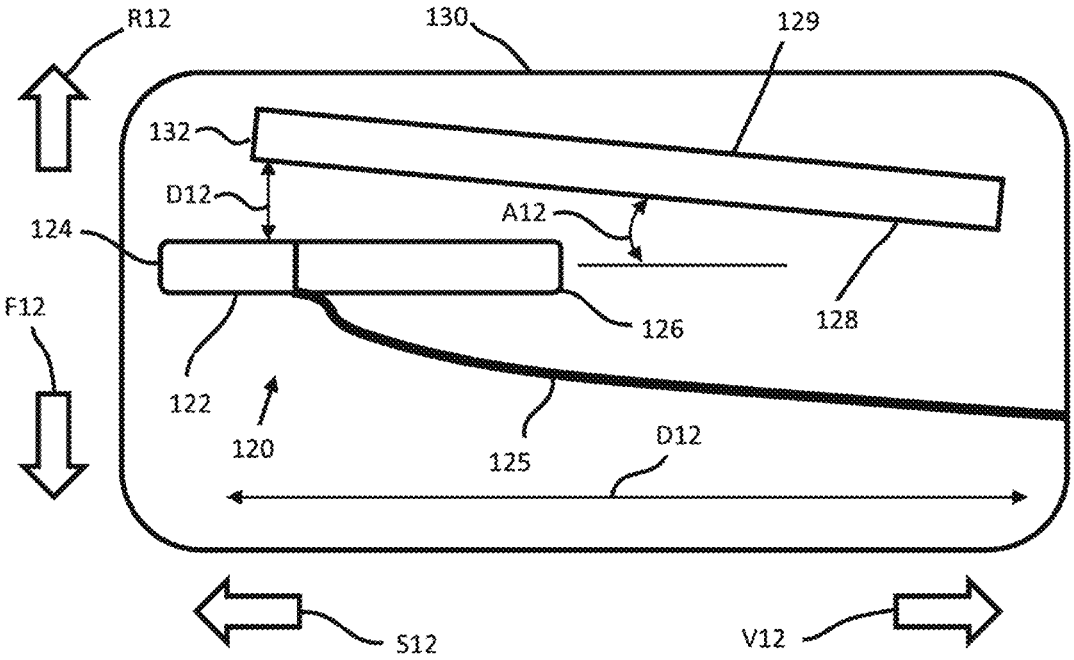
FIG. 12 illustrates a top view of an example antenna and antenna housing.

FIG. 12 illustrates a top view of an example antenna 120 and antenna housing 130.

The antenna 120 may be located in the antenna housing 130, such as an antenna housing comprising a side mirror of an automotive vehicle. The antenna 120 may comprise an antenna element 122 (e.g., antenna pattern) connected to an antenna cable 125. Additionally, the antenna 120 may comprise a signal attenuation or gain reduction portion 126. In some examples, the antenna element 122 may be located at or near a first end of the antenna 120 on an antenna board 124, and the signal gain reduction portion 126 may be located at a second end of the antenna 120 opposite the first end.

The antenna housing 130 may comprise one or more signal blocking structures 129, such as a mirror or a metallic component. The antenna element 122 may be located beyond the outer peripheral edge 132 of the structure 129 to provide a clear path for receipt of signals. On the other hand, the signal gain reduction portion 126 may be located within the outer peripheral edge 132 of the structure 129 with respect to the planar view of the antenna 120. With reference to FIG. 12, the antenna element 122 may be located in a portion at or near an end of the antenna housing 130 in the direction of the signal S12, and at the end further away from the direction of the vehicle V12 or mounting structure.

In some examples, the signal gain reduction portion 126 may be located behind a reflective surface of a side view mirror. With respect to FIG. 12, the antenna 120 may be generally understood to be on a side of the structure 129 (e.g., side view mirror) in the direction of the front of the vehicle F12, with the reflective surface of the side mirror facing in the direction of the rear of the vehicle R12. For example, the reflective surface of the side view mirror may be configured to face the rear of the vehicle R12, and the first end of the antenna substrate extends past an outside edge of the reflective surface from a front end perspective of the vehicle. Additionally, the second end of the antenna substrate may be located behind the reflective surface from the front end perspective.

The signal reception associated with the antenna 120 may be adjusted or modified according to the angle A12 between the antenna 120 and the structure 129, and the distance D12 of the antenna 120 to the vehicle, by way of example. The antenna may be installed in a mirror at the position which is farthest from the vehicle body to avoid the effects of metal parts inside the mirror and the vehicle body. For example, the antenna may be placed at outer edge of mirror to avoid creating additional reflections to interfere with the radiation pattern result. There is a balance of placement between the mirror and the edge, since the mirror may act as reflector. In some examples, the antenna may be located at the top outer corner of the mirror The ground plane may be located on the same flat plane to reduce gain towards rear of antenna 120 and to reduce the size of the antenna 120. Additionally, an EBG structure may be used to reduce the size of the antenna even further, and also to reduce the distance from antenna element to ground structure. The angle of the antenna 120 may be adjusted reduce interference. For example, if a large amount of reflections are being received from a certain surface nearby, the angle of the antenna 120 may be adjusted to have those reflections cancelled out or reduced completely by reducing the antenna gain of the antenna 120 in the direction of the nearby surface.

Figure 13:
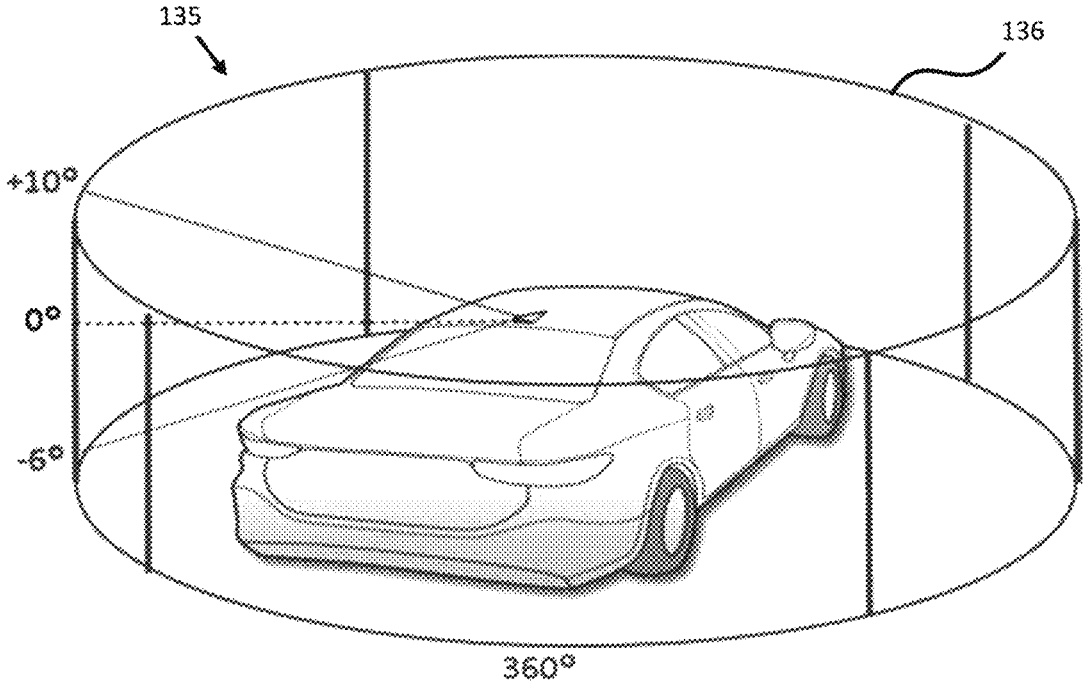
FIG. 13 illustrates another example communication system including a partial hemispherical-shaped signal reception region.

FIG. 13 illustrates another example communication system 135 including a hemispherical-shaped or partial hemispherical-shaped signal reception region 136. In some examples, the partial hemispherical-shaped signal reception region 136 may be formed provide a 360 degree signal reception coverage around the vehicle, which may be determined within the range from +10 degrees to −6 degrees from a horizontal plane (0 degrees) that passes through one or more reference points, such as an antenna of the communication system 135.

Figure 14:
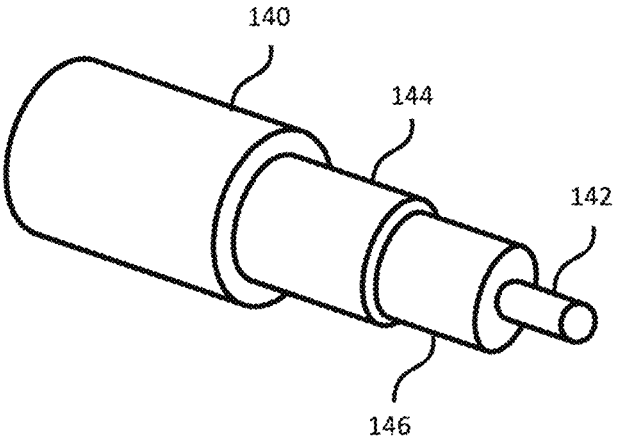
FIG. 14 illustrates an example antenna cable.

FIG. 14 illustrates an example antenna cable 140 which may be used with one or more of the example antennas described herein. The antenna cable 140 may comprise a first conductive element 142 and a second conductive element 144 electrically insulated from the first conductive member 142 by an insulating layer 146. In some examples, an antenna element such as a dipole antenna may have two terminals, including an antenna terminal and a cable terminal. The antenna terminal may be electrically coupled to both a signal gain reduction portion of the antenna and the second conductive element 144. The cable terminal may be electrically coupled to the first conductive element 142. In some examples, the second conductive element 144 of the antenna cable 140 may be configured to provide an electrical ground.

Figure 15:
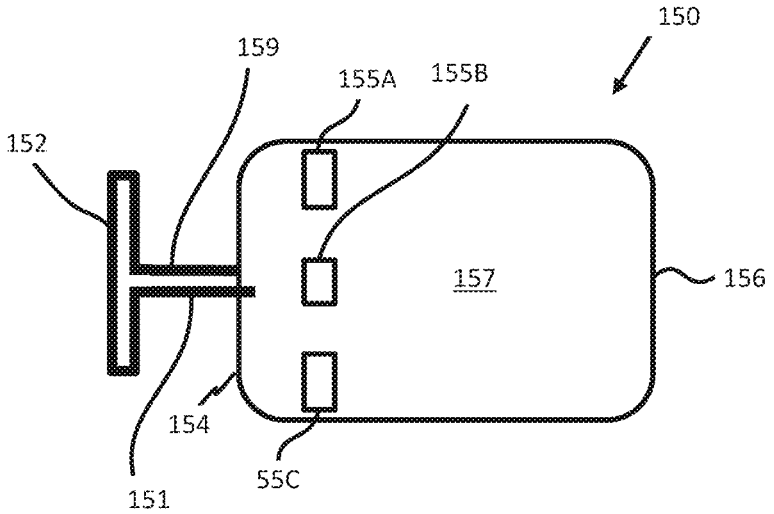
FIG. 15 illustrates another example antenna.

FIG. 15 illustrates an example antenna 150 comprising a signal attenuating structure or signal gain reduction structure 156.

The antenna 150 comprises an antenna element 152 configured to emit and/or receive signals. The antenna element 152 may be located at a portion near an end 154 of an antenna board. Additionally, the antenna element 152 may include or be coupled to an antenna terminal 151 and a cable terminal 159.

The signal gain reduction structure 156 may comprise one or more signal attenuation features 155A, 155B, 155C formed in a surface layer 157. In some examples, the plurality of signal attenuation features 155A, 155B, 155C may be configured similarly to the signal attenuation features 55A, 55B, 55C as described with reference to FIG. 5.

The surface layer 157 may comprise a conductive material coupled to the antenna terminal 151. The surface layer 157 may be formed on a substrate of the signal gain reduction structure 156, to form a coplanar EBG structure. The antenna element 152 may comprise a metal dipole element coupled with the coplanar EBG structure. The coplanar EBG structure may be configured to reduce radiation towards a rear of the antenna 150, e.g., toward the opposite end of the signal gain reduction structure 156 from the end 154.

Although the antenna element 152 is illustrated as comprising a dipole element, in other examples, the antenna element 152 may comprise a monopole antenna. Additionally, whereas certain example antenna elements are described as including a pattern formed on a substrate, in other examples the antenna element 152 may comprise a metal wire or a metal plate located at or near the end 154 of the signal gain reduction structure 156.

Figure 16:
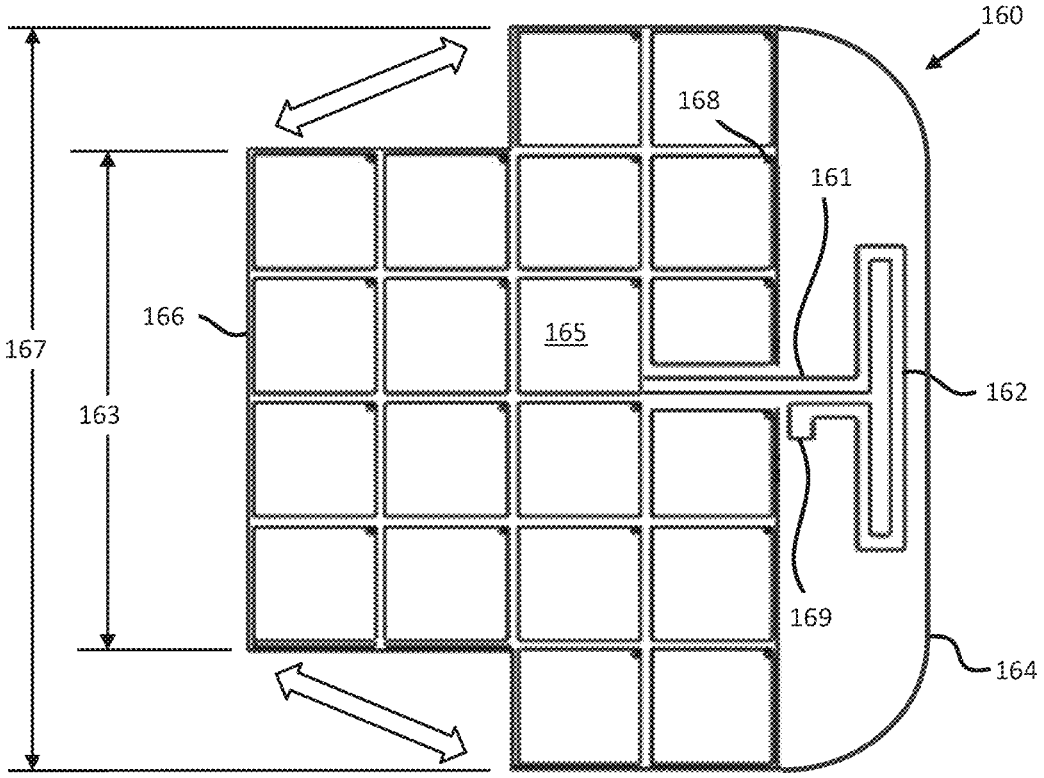
FIG. 16 illustrates yet another example antenna.

FIG. 16 illustrates yet another example antenna 160. In some examples, the antenna 160 may comprise a double-sided signal attenuation or gain reduction structure similar to the antenna 90 illustrated in FIGS. 9 and 10.

The antenna 160 comprises an antenna element 162 (e.g., antenna pattern) formed on a first portion or near a first end of an antenna board or antenna substrate 164. Additionally, the antenna element 162 may include or be coupled to an antenna terminal 161 and a cable terminal 169.

A signal gain reduction structure 166 may comprise one or more signal attenuation features 165 formed on a portion of the signal gain reduction structure 166 opposite the antenna element 162. In some examples, the signal attenuation features 165 may comprise a conductive material coupled to the antenna element 162. The signal gain reduction structure 166 may be substantially coplanar with the antenna substrate 164. Additionally, signal attenuation features 165 may be substantially coplanar with the surface of the antenna element 162.

The signal attenuation features 165 may be configured as a plurality of rows each comprising a number of features located on a surface of the signal gain reduction structure 166. In some examples, the signal attenuation features 165 may be separated from each other by a non-conductive portion of the signal gain reduction structure 166.

Each of the signal attenuation features 165 may comprise a through-hole 168. The through-hole 168 may penetrate through the signal gain reduction structure 166. Additionally, the through-holes 168 may comprise conductive inner surfaces which are electrically coupled to the signal gain reduction structures 166. In some examples, an opposite side of the antenna 160 may be configured similarly as the antenna 90 illustrated in FIG. 10.

The signal gain reduction structure 166 may comprise a tapered or sloped shape (in the direction of the large arrows). In some examples, a surface area of the signal gain reduction portion 166 decreases in width from a wide portion 167 to a narrow portion 163 located toward the second end of the antenna substrate 164. For example, the wide portion 167 may comprise a larger number of signal attenuation features 165 along the width of the signal gain reduction structure 166 as compared to the narrow portion 163.

In some examples, the narrow portion 163 of the signal gain reduction structure 166 may be located on the side of the antenna 160 closest to the vehicle body. The tapered shape of the signal gain reduction structure 166 may be configured to reduce reflections at particular elevation angles and improve overall result and stability of elevation gain. In some examples, the antenna 160 may be configured to adjust the gain cut off towards the rear of the vehicle.

It is to be understood that not all aspects, advantages and features described herein may necessarily be achieved by, or included in, any one particular example embodiment. Indeed, having described and illustrated various examples herein, it should be apparent that other examples may be modified in arrangement and detail.

An example antenna may be configured to include a variety of artificial structures. Structures with opposite polarities of permittivity ($\varepsilon$) and permeability ($\mu$) may be understood to generally prohibit the propagation of waves, such as electromagnetic band gaps. In some examples, the antenna may comprise artificial structures with negative permittivity and negative permeability. The example antenna structures may be configured to create a backwards wave from the original propagation once the wave reaches these artificial structures. The antenna structures may be configured to direct the propagation away from the rear, and towards the sides and the front.

Still further, the antenna may include structures with an electromagnetic band gap to suppress surface waves causing interference, thereby increasing the antenna efficiency while decreasing the size of the antenna, and also reducing edge currents to reduce radiation into the back hemisphere.

In addition to folded dipoles, other antenna shapes such a monopole and non-V2X antenna designs can be combined with one or more of the features described herein. The antenna may configured to provide a half-moon radiation type pattern covering half the vehicle, such as where a pair of antennas are used in the two side view mirrors.

The beams of the defective ground may be attenuated and/or reflected in order to reduce the amount of radiation directed towards the vehicle body. For example, the gain towards the vehicle body may be reduced in order to nullify any effect of the reflections on the gain radiating away from the vehicle, while maintaining 180 degree coverage of the vehicle with each of the two antennas (e.g., using the Hemisphere/Half Moon Radiation Pattern). If size was not a constraint a large reflector could be used to reduce the gain.

In order to minimize the size of the antenna, attenuation may be used with or without the inclusion of shielding. In some examples, an antenna configured with an EBG may be used to selectively attenuate the radiation towards one or more particular locations. For example, if the gain is reduced at a certain angle away from the vehicle due to strong reflections from the vehicle body structure, a section of the EBG could be oriented to help attenuate the gain in that direction and reduce reflections which cause interference.

In some examples, the EBG may be non-planar, for example it could be on a film and be curved. In this manner, the radiation pattern may be shaped in a number of different ways other than as a flat static surface.

Whereas certain examples described herein may be understood to operate with V2X technologies, in other examples one or more antennas may be configured to receive signals and/or control radiation patterns associated with frequency modulation (FM), amplitude modulation (AM), digital audio broadcasting (DAB), digital television (DTV), telephone, cellular, other types of transmissions, or any combination thereof.

We claim all modifications and variations coming within the spirit and scope of the subject matter claimed herein.

I claim:

1. An antenna, comprising:

an antenna substrate comprising a first end and a second end;

an antenna element attached to the antenna substrate and configured to receive communication signals within a partial hemispherical-shaped signal reception region oriented about the first end of the antenna substrate; and a signal gain reduction portion at least partially located between the antenna element and the second end of the antenna substrate, the signal gain reduction portion configured to reduce signal gain in an opposite partial hemispherical-shaped region oriented about the second end of the antenna substrate.

2. The antenna of claim 1, wherein the signal gain reduction portion comprises a plurality of signal attenuation features at least partially formed in a surface layer of the signal gain reduction portion.

3. The antenna of claim 2, wherein the plurality of signal attenuation features are linearly arranged perpendicular to a longitudinal direction from the first end to the second end of the antenna substrate.

4. The antenna of claim 2, wherein the antenna element comprises a conductive pattern formed on the antenna substrate, and wherein the conductive pattern is substantially coplanar to the surface layer of the signal gain reduction portion.

5. The antenna of claim 4, wherein the antenna element is electrically coupled to the surface layer of the signal gain reduction portion.

6. The antenna of claim 4, wherein the signal attenuation features comprise an array of non-conductive signal attenuation features arranged as a plurality of rows, the array of non-conductive signal attenuation features etched from the surface layer.

7. The antenna of claim 2, wherein the signal attenuation features comprise a number of through holes that pass through the surface layer to an opposite side of the of the signal gain reduction portion.

8. The antenna of claim 7, further comprising a conductive layer formed on the opposite side of the signal gain reduction portion, wherein the through holes include conductive features that electrically couple the surface layer to the conductive layer.

9. The antenna of claim 8, wherein the antenna element is electrically coupled to the conductive layer.

10. The antenna of claim 1, further comprising an antenna cable comprising a first conductive element and a second conductive element electrically insulated from the first conductive member, wherein the antenna element comprises a dipole antenna having two terminals, including a first terminal electrically coupled to both the signal gain reduction portion and the first conductive element, and a second terminal electrically coupled to the second conductive element.

11. The antenna of claim 10, wherein the first conductive element of the antenna cable is configured to provide an electrical ground.

12. The antenna of claim 10, wherein the antenna element and the surface layer are located on a face of the antenna substrate, and wherein the surface layer covers at least 50% of the face of the antenna substrate.

13. The antenna of claim 1, wherein the signal gain reduction portion comprises:

a first signal attenuation surface located substantially coplanar to the antenna element; and a second signal attenuation surface spatially offset from the first signal attenuation surface, wherein the antenna element is electrically coupled to the second signal attenuation surface.

14. The antenna of claim 13, wherein the second signal attenuation surface is attached to the antenna substrate, and wherein the second signal attenuation surface is angularly offset from the first signal attenuation surface.

15. An antenna assembly including the antenna of claim 1, the antenna assembly comprising:

an antenna housing containing the antenna; and a signal blocking structure oriented substantially lengthwise in the antenna housing, wherein the first end of the antenna substrate extends outside the signal blocking structure from a front side perspective of the antenna housing, and wherein the second end of the antenna substrate is located behind the signal blocking structure from the front side perspective.

16. The antenna assembly of claim 15, further comprising a second antenna housing, wherein the second antenna housing contains a second antenna including:

a second antenna element configured to receive communication signals within a second partial hemispherical-shaped signal reception region, wherein the second partial hemispherical-shaped signal reception region combined with the partial hemispherical-shaped signal reception region forms a 360 degree signal reception region; and a second signal gain reduction portion configured to reduce signal gain in a second partial hemispherical-shaped region oriented opposite to the second partial hemispherical-shaped signal reception region.

17. An antenna assembly including the antenna of claim 1, the antenna assembly comprising a side view mirror for a vehicle, the side view mirror containing the antenna, wherein the first end of the antenna substrate is configured to be directed away from the vehicle, and wherein the second end of the antenna substrate is configured to be directed toward the vehicle.

18. The antenna assembly of claim 17, wherein a reflective surface of the side view mirror is configured to face a rear end of the vehicle, wherein the first end of the antenna substrate extends past an outside edge of the reflective surface from a front end perspective of the vehicle, and wherein the second end of the antenna substrate is located behind the reflective surface from the front end perspective.

19. The antenna assembly of claim 17, further comprising a second side view mirror, wherein the second side view mirror contains a second antenna including:

a second antenna element configured to receive communication signals within a second partial hemispherical-shaped signal reception region; and a second signal gain reduction portion configured to reduce signal gain in a partial hemispherical-shaped region oriented opposite to the second partial hemispherical-shaped signal reception region, wherein the signal gain reduction portion of the antenna and the second signal gain reduction portion of the second antenna are both configured to attenuate signals which are reflected from the vehicle.

20. The antenna of claim 1, wherein a surface area of the signal gain reduction portion decreases in width from a wide portion to a narrow portion located toward the second end of the antenna substrate.

* * * * *